United States Patent [19]

Maas et al.

[11] 4,104,057

[45] Aug. 1, 1978

[54] METHOD FOR MAKING LOW CARBON HIGH CHROMIUM ALLOYED STEELS

[76] Inventors: Hermann Maas, Niermannsweg 11, Gelsenkirchen; Franz-Josef Hahn, Gabelsberger Str. 9, Dortmund, both of Germany

[21] Appl. No.: 692,758

[22] Filed: Jun. 4, 1976

Related U.S. Application Data

[60] Division of Ser. No. 685,771, May 12, 1976, abandoned, and a continuation of Ser. No. 366,491, Jun. 4, 1973, abandoned.

[30] Foreign Application Priority Data

Jun. 10, 1972 [DE] Fed. Rep. of Germany ..... 2228462

[51] Int. Cl.[2] ..... C21C 7/10; C22C 33/00

[52] U.S. Cl. ..... 75/49; 75/130.5

[58] Field of Search ..... 75/49, 130.5

[56] References Cited

U.S. PATENT DOCUMENTS

| | | | |
|---|---|---|---|
| 3,136,834 | 6/1964 | Lorenz | 75/49 |
| 3,268,326 | 8/1966 | Hardens | 75/49 |
| 3,320,053 | 5/1967 | Lehman | 75/49 |
| 3,737,302 | 6/1973 | Pomey | 75/49 |
| 3,798,025 | 3/1974 | Ramachandrau | 75/49 |

*Primary Examiner*—Peter D. Rosenberg

*Attorney, Agent, or Firm*—Parmelee, Miller, Welsh & Kratz

[57] ABSTRACT

A low carbon high chromium alloyed steel is made by an underpressure treatment wherein a steel melt with a high chromium and carbon content is supplied with a gaseous decarbonization agent while it is maintained at an underpressure. At the beginning of the underpressure treatment the steel flows upwardly from a ladle through an inlet into a reaction vessel and no decarbonization agent is supplied. In a second phase of the treatment a high quantity of decarbonization agent is added directly to the melt which flows upwardly from the ladle into the reaction vessel. In a third treatment phase a small quantity of decarbonization is supplied. The melt is subsequently deoxidized and alloy corrected and it is then poured off from the reaction vessel. The apparatus includes a reaction vessel which has a downwardly extending inlet connected to the ladle and an outlet spaced from the inlet extending down into the ladle within the melt thereof. The inlet includes means for directing a decarbonization agent directly into the inflowing melt at the inlet. The apparatus includes a downwardly extending oxygen blow lance which is sealed at its entrance into the top of the vessel and which is water cooled by a surrounding water cooling jacket system. The vessel also includes an inlet for additional alloy materials.

5 Claims, 2 Drawing Figures

METHOD FOR MAKING LOW CARBON HIGH CHROMIUM ALLOYED STEELS

This is a continuation, of application Ser. No. 366,491, filed June 4, 1973, now abandoned; and a divisional application for the apparatus has been filed, Ser. No. 685,771, on May 12, 1976, now abandoned.

BACKGROUND OF THE INVENTION

1. Field of the Invention

This invention relates in general to a method and apparatus for making low carbon high chromium alloyed steels and in particular to a new and useful method of treating a high chromium low carbon melt with gaseous decarbonization agents while it is maintained at an underpressure and to an apparatus for carrying out the method.

2. Description of the Prior Art

In a known method for making low carbon high chromium alloyed steels by means of an underpressure treatment, molten steel having the approximate desired chromium content and high carbon content is first desulfurized in an electric furnace ladle and then treated by means of a recycle degassing arrangement. During the degassing oxygen is blown upon the melt in the ladle for oxidation of the carbon. This method enables a reliable contacting of the oxygen with the melt. However, when oxygen is blown upon the melt the chromium-oxygen equilibrium is exceeded at least locally whereby a chromium slagging occurs. This disadvantage is avoided by blowing oxygen upon chromium and carbon rich melt in a furnace maintained at underpressures. By the displacement of the carbon-oxygen equilibrium because of the underpressure to lower concentrations of the reaction partners below the equilibrium of the chromium slagging the carbon serves as a protective element. This method is disadvantageous inasmuch as the slag must be removed before the treatment of the melt and this is an increased expenditure that makes the completion of the melt a relatively costly operation which must be carried out in a vacuum melting furnace or a vacuum induction furnace which becomes blocked up during the entire making of the melt from the melting to the tapping. In another arrangement an efficient electric arc furnace is employed only during the time of the melting period. Other methods have the disadvantage that they are costly, particularly on large scales. None of the known methods disclose any efficient way of introducing the oxygen during the blowing without great losses.

SUMMARY OF THE INVENTION

In accordance with the present invention a high chromium alloy low carbon steel is made by the controlled supplying without losses of a decarbonizing oxygen to the surface of the steel bath under such conditions that a quick decarburization is insured while avoiding a chromium slagging. With the invention the method is carried out by a combination of (1) a recycle degassing installation which comprises a steel receiving container with an inlet pipe and a gas intake and an outlet pipe separated from the inlet pipe and with (2) a water cooled blowing lance having a nozzle that is introduced through the top of the reaction vessel in vacuum tight sealing therewith so that its axis is directed toward the steel therein.

In the arrangement of the invention steel which is in a molten condition after having been subjected to heating in an electric arc furnace, for example, and which is a high chromium carbon rich steel without having its slag removed, is positioned in a ladle and is submitted to carbon oxidation while avoiding chromium slagging. In the arrangement the melt flows from the ladle into the reaction vessel through an inlet pipe which is connected through the melt below the slag layer so that the melt is slag free. Oxygen is blown downwardly onto the surface of the melt which is introduced into the vessel and always upon new turbulent portions of the melt and the melt then flows off through the outlet. The blowing takes place upon a large surface area namely the surface enlarged by an intense boiling reaction thus giving rise to a high reaction rate. A concentration increase which would result in a separation of chromium oxides is prevented by the quick movement of the melt from the steel receiving container and the continuous supply of a new oxygen poorer melt portion from the ladle which is located directly under the receiving vessel. The under pressure of the vessel at the location of the oxygen supply allows the carbon to become efficient as a protecting element for the chromium. The controlled introduction of oxygen with small losses into the melt bath surface without absorbing the oxygen is made possible by the pumps of the recycle degassing installation by developing the blowing lance as a water cooled lance which is provided with a nozzle at its lower end. The nozzle enables the directing of the gaseous oxidizing jet at high kinetic energy into the bath. The introduction of an uncooled lance whose partial burning off and clogging is connected to the residue of a lateral jet deflection, and which would have an unreliable oxidizing agent supply, would cause oxidation agent losses and a bad efficiency. Systematic tests, based on theoretical estimations by the applicant have shown that the introduction of a water cooled lance into the inside space of the steel receiving container of the recycle degassing installation having a temperature of about 1600° is possible without an explosion hazard.

The details of the invention are developed advantageously as follows:

The distance of the nozzle of the lance from the bottom of the steel receiving container is advantageously made from 1 to 2½ meters. The average filling height of the steel receiving container is of between 40 to 50 centimeters and the distance of the nozzle from the bath surface is from ½ to 2 meters. With this arrangement a uniform and efficient supply of the melt with the blown in oxygen is attained. In addition at this distance the lance is sufficiently protected against strong influences of the liquid steel and particularly against splashing of the steel.

An efficient water cooling is attained by forming the lance of three concentric tubes with cooling water being supplied between the inner and the middle and between the middle and the outer tubes. In such an arrangement it is possible to direct cold water to the particularly heat stressed nozzle at the inner tube at a location where it is protected against the high temperature of the steel in the receiving container. As an additional protection the lower part of the lance is provided with a fire resistant jacket. The lance is introduced into the top of the receiving vessel in a packing which seals the lance laterally within the entrance bore. The construction permits a shift of the lance axially in respect to the height above the melt even during oxidation. The shifting can be carried out by a shifting device preferably by a hydraulic shifting device. An efficient admission of gaseous decarbonization agents upon the melt in the steel receiving container is attained by directing the axis of the lance toward the muzzle of the inlet tube in the steel receiving container.

With the inventive device a low carbon high chromium melt can be prepared advantageously from a high chromium and high carbon melt by blowing gaseous oxidation agents into the under-pressure receiving vessel in such a way that at the beginning of the under-pressure treatment during the flow of the steel from the ladle through the recycle degassing container in a first treatment phase, no oxidizing agent is supplied. In a second treatment phase large quantities of oxidizing agent are supplied and in a third treatment phase small quantities of oxidizing agents are supplied. Subsequently the melt is deoxidized and the alloy consistency is corrected and then the melt is poured off.

During the first treatment phase the steel has still sufficient oxygen for the making of the carbon reduction reaction. The large quantities of oxidizing agent in the second treatment phase cause high reaction rates with the still high carbon content steel but with a reliable protection of the chromium. In the third phase, by the supply of small quantities of decarbonizing agent even with the smaller carbon content present, chromium slagging is securely prevented. The adjustment of the final analysis by addition of correction substances and by deoxidation then takes place at the end of the treatment.

The method of the invention is advantageously developed in the following manner:

It is advantageous at the beginning of the treatment in the first treatment phase when due to the high carbon and oxygen content an intense splashing occurs, to keep the blowing nozzle free and at a distance of more than 2 meters from the bath and to supply it with an inert gas such as argon or nitrogen. In the second treatment phase with a smaller clearance between the lance nozzle and the melt of about 1 meter a decarbonizing agent is blown through the lance nozzle at high pressure and in large quantities. In the third phase the carbon content of the melt is very low and by a hard blowing the peril of chromium oxidation would exist so that the lower quantities of decarbonization agent are blown under lower pressure and the spacing of the nozzle from the bath surface is about 2 meters. The lowering of the oxygen quantity toward the end of the decarbonization process when attaining low carbon contents in steel for preventing chromium losses, leads to a decrease in the kinetic energy of the blowing jet so that there is no possibility that there will be a narrow blowing cone directed against the steel with resultant loss in efficiency. For maintaining optimum blowing conditions it is advantageous to supply the outlet opening of the blowing lance which is designed as a Laval nozzle with the most constant gas quantity that is possible even when the inert gases, preferably argon are directed through the lance nozzle during the diminishing supply of decarbonizing agent. At all times it is preferably to insure that the blowing processes are carried out with the same quantities of gas leaving the nozzle and this is accomplished by dilution of the oxygen with argon. This brings a further advantage of an additional protectior against chromium slagging when striving at extremely low final carbon content in steel.

A further progress in the carbon drop may be attained by supplying additional decarbonizing gas through the gas intake of the inlet tube of the recycle gassing installation. The decarbonizing gas can be according to the desired decarbonizing effect, air, carbon dioxide and oxygen or a mixture of these gases. Since in the supply of pure oxygen through the gas intake of the gas inlet tube in the inlet point, very high temperatures arise and there is the danger of burning the gas inlet nozzles, it is advantageous to use a gaseous mixture of argon and oxygen. This mixture can comprise changing mixture ratios and be employed with a content of 100% into a ratio of 30% argon and 70% oxygen.

It is advantageous to carry out the decarbonization in the recycle degassing installation only by introducing decarbonizing gases into the intake pipe when in the vacuum decarbonization treatment the carbon content to be reduced must not be very large. Chromium melts treated in this way can have the carbon content reduced with certainty from 0.08% at the beginning of the treatment to below 0.02% and while avoiding a chromium slagging. The fact that by changing the decarbonization conditions, a desired oxidation not only of the carbon but also of the alloying elements in the steel melt can be achieved can be used to oxidize selectively the chromium in a melt having a too high chromium content. In addition there is a possibility of heating up melts which become too cold even if in such a case an unavoidable loss of alloying agents occurs.

The progress can be automated by continuously analyzing the gases which are aspired from the recycle degassing installation in respect to their quantity and to their CO, $CO_2$ and $O_2$ content and the resultant analysis which is achieved may serve as a control value. In such a case the blowing would start in the second treatment phase in a more efficient way when a gas quantity and the CO content have fallen below a predetermined limit value, and in the third phase when both contents have fallen below a further predetermined limit value. The blowing is ended when the quantity and analysis of the residual gases indicate that the desired final carbon content is attained.

A further possibility of supervising and controlling the decarbonization during the decarbonization treatment is obtained by measuring the temperature of the steel melt in the ladle. Because of the under-pressure in the treatment vessel and because only the carbon of the melt is oxidized there is little heat released in the reaction and only a moderate temperature increase of the steel melt occurs. However as soon as the carbon content falls below a critical value the oxidation of the other alloying elements and the iron itself sets in leading to a sudden increase of the steel temperature. The value of the critical carbon content is variable and depends in addition to the under-pressure amount in the treatment vessel also upon the type and concentration of the alloying elements as well as the blowing conditions. In order to avoid losses of alloy the decarbonization conditions have to be modified from the moment of a sudden temperature increase.

The present invention therefore has for its principal object to process metal in an open ladle by the use of a degassing system through which the molten metal is circulated from the ladle through a degassing chamber in which a reduced pressure is maintained by the controlled supply of oxygen or other decarbonizing gas introduced into the chamber above the molten metal in the chamber at a variable rate so controlled in conjunction with the reduced pressure or vacuum in the reaction chamber as to protect chromium in the steel from unwanted oxidation.

For an understanding of the principles of the invention, reference is made to the following description of a typical embodiment thereof as illustrated in the accompanying drawing.

GENERAL DESCRIPTION OF PREFERRED EMBODIMENT

Figure 1:
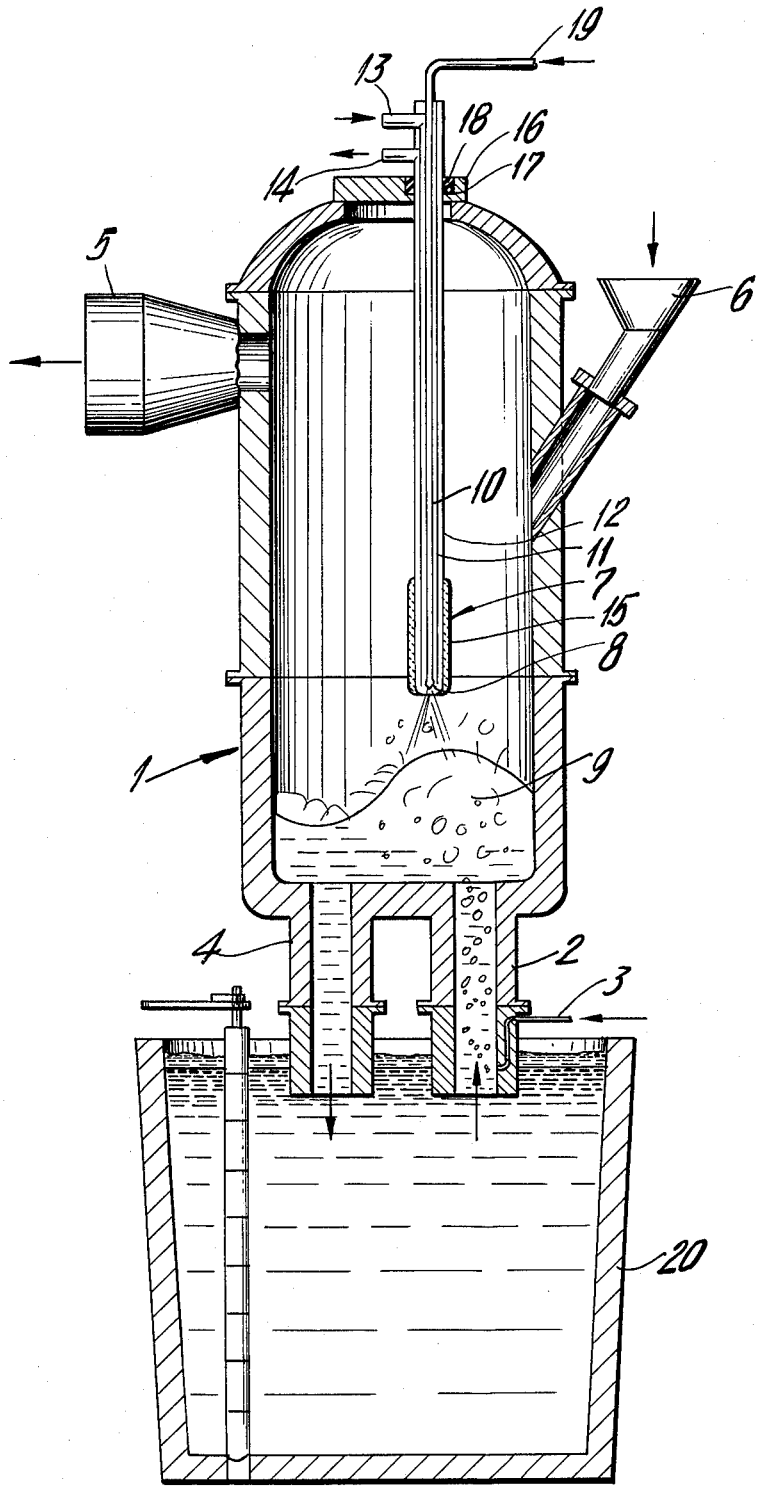
FIG. 1 is a schematic representation of a longitudinal section through a recycle degassing installation constructed in accordance with the invention.

Referring to the drawings in particular the invention embodied therein comprises an arrangement for making low carbon high chromium alloy steels with the aid of an under-pressure treatment and which includes a receiving container or reaction vessel generally designated 1 located above a ladle 20 of a steel melt which is to be treated.

In accordance with the invention the receiving container 1 includes an inlet pipe 2 having a gas intake 3 which discharges directly into the inlet 2. An outlet pipe 4 is separated from the inlet pipe 2 and it also discharges into the ladle 20. The upper end of the receiving container 1 includes a gas aspiration fitting 5 and an alloy addition inlet 6 both of which may be closed to maintain an under-pressure within the vessel during operation. A water-cooled blowing lance 7 having a discharge nozzle 8 oriented downwardly above the melt level 9 extends through a vacuum tight seal of a packing 18 carried in a cover which is fitted vacuum tight in a bore 17 at the top of the vessel. The distance of the nozzle 8 of the lance from the bottom of the steel receiving container 1 is from 1 to 2½ meters.

In accordance with a feature of the construction the lance 7 is water cooled by a cooling system which comprises three concentrically arranged pipes 10, 11 and 12 with an inlet for cooling water 13 connected between the inner pipe 10 and the middle one 11 and the outlet 14 for the cooling water connected between the middle tube 11 and the outer tube 12. The lower part of the lance comprises a fire resistant jacket 15. A reliable cooling of the lance is achieved by the supply of water with an over-pressure of 10 gage atmospheres in the intake 13 and the circulation is carried out to maintain the outlet temperature of the water under 50° C. The lance is shiftable through the packing of the cover 16 in an axial direction by means of a hydraulic shifting device (not shown) which is connected thereto exteriorly of the vessel. The decarbonizing gas is supplied through an inner pipe 10 and flows in the direction of the arrow 19.

An example of an operation of the machine to make a high chromium alloy carbon melt is as follows:

A steel melt with 18.1% chromium and 10.1% nickel and an initial carbon content of 0.61% was decarbonized in an electric furnace down to 0.19%. The melt was drawn off into a normal pouring ladle 20 and submitted to a recycle degassing treatment in the receiving vessel 1. During the treatment of 40 minutes total the following phases were carried out. From the 9th to the 25th minute an oxygen quantity of 400 standard cubic meters per hour was supplied through the blow lance 7 and discharged against the melt 9. In a second phase from the 25th to the 33rd minute an oxygen quantity of 200 standard cubic meters per hour were blown upon the melt which was recycled through the vessel 1. During this phase the carbon content was lowered from 0.19% to 0.016%, the chromium content remained practically constant within the analysis accuracy. The steel temperature was 1680° C before the decarbonizing treatment. The temperature fell at the beginning of the treatment due to the process and was increased again during the oxygen blow. At the end of the treatment the steel temperature amounted to 1640° C. Subsequently the melt was deoxidized by the addition of alloying means under vacuum and the melt was alloy corrected and then poured off.

Figure 2:
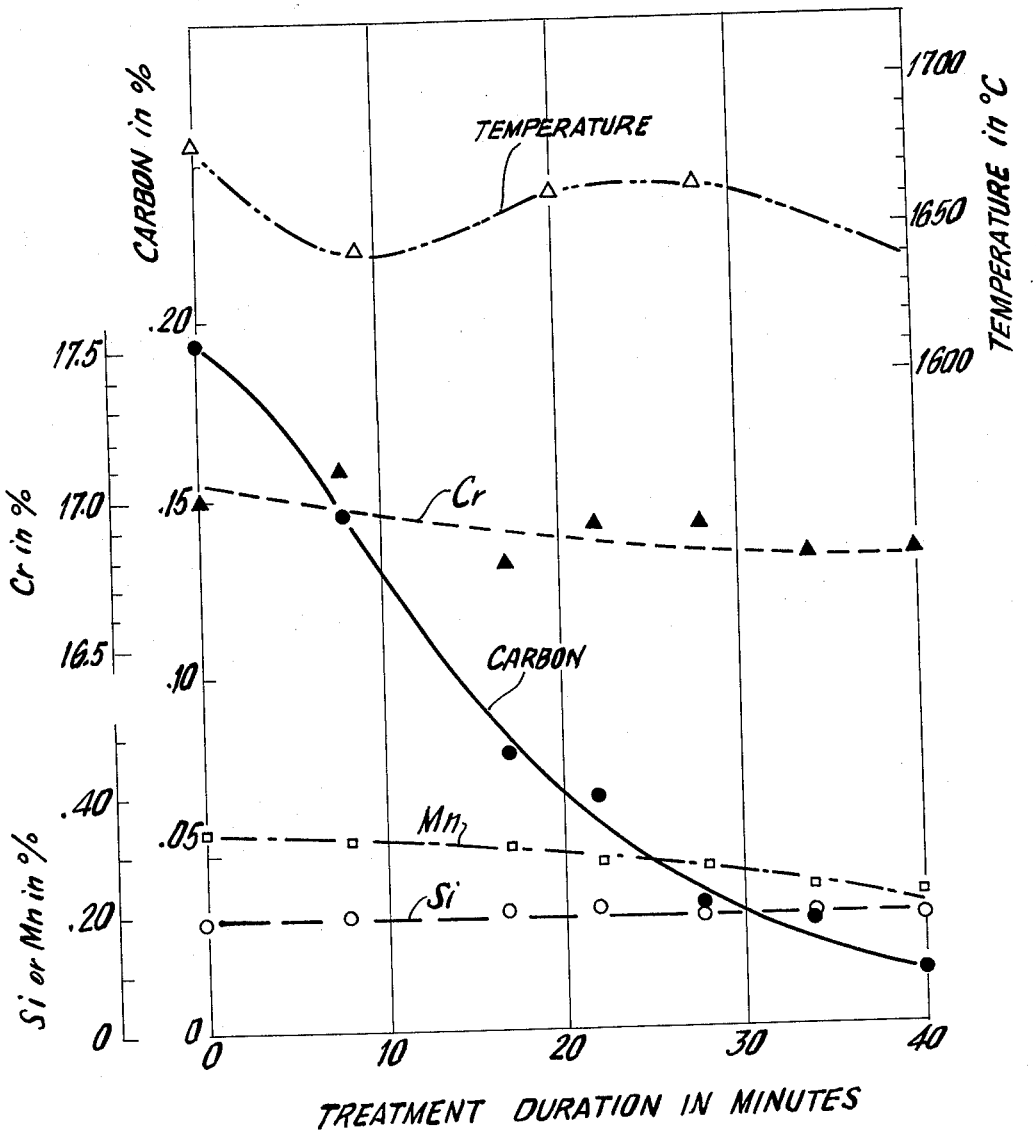
FIG. 2 is a graphical representation of the development in time of the content of the treated melt of chromium, silizium, manganese and carbon in respect to the temperature.

As shown in FIG. 2 there is a graphic representation of the analysis which results during the course of the treatment. The steel melt thus obtained corresponds to material No. 1.4306 with symbol X 2 CrNi 189. The final analysis shows the following composition:

| C | Si | Mn | Cr | Ni | P | S |
|---|---|---|---|---|---|---|
| 0.020 | 0.46 | 1.24 | 17.6 | 10.6 | 0.026 | 0.015% |

In the preferred method of the invention during the treatment when the steel is flowing from the ladle 20 upwardly through the intake 2 into the receiving vessel 1 which forms a recycle degassing container no decarbonization agent is supplied through the lance 7 in a first treatment phase. In a second treatment phase high decarbonization agent quantities are supplied and in a third treatment phase small decarbonization agent quantities are supplied. The melt is then deoxidized and alloy corrected and then poured off.

In a first treatment phase it is preferable to arrange the lance at about 2 meters from the end of the nozzle 8 to the steel bath 9. Inert gas such as argon or nitrogen is advantageously blown through the lance in the first treatment phase. In the second treatment phase a smaller distance of about 1 meter from the end of the nozzle 8 to the melt is maintained and oxygen in large amounts is blown through the lance. In the third phase a distance of about 2 meters is maintained between the nozzle 8 and the melt. In this latter phase oxygen is blown through the lance in only smaller quantities. When the low quantities of decarbonization agents are blown inert gases such as argon are added in such amounts that during the whole blowing course there are always constant gas quantities per unit of time which flow out from the nozzle 8. Additional decarbonization gas is added through the inlet 3 to the intake pipe 2 during portions of the process. The additional decarbonization gas may comprise for example a mixture of argon and oxygen. Preferably a mixture of oxygen and argon is introduced only into the inlet pipe 2 through the supply pipe 3.

In the preferred operation of the method the gases which are aspired from the recycle degassing installation are continuously analyzed as to their carbon monoxide, carbon dioxide and oxygen content and the quantities are measured and the results used as a control value for carrying out the method. In addition the temperature of the steel bath is continuously measured and the carbonization is controlled when sudden temperature rises occur.

While a specific embodiment of the invention has been shown and described in detail to illustrate the application of the principles of the invention, it will be understood that the invention may be embodied otherwise without departing from such principles.

What is claimed is:

1. In the process of producing a high chromium, low carbon alloy steel from a melt of high chromium, high carbon steel through the oxidation of carbon with oxygen and the removal of CO and $CO_2$ gas while minimizing the oxidation of chromium and the resulting formation of chromium slag, by positioning a recycle vacuum degassing unit in which there is a vacuum chamber with two depending open-ended legs, one of which is a riser leg and the other of which is a down leg with the chamber at an elevation where the said legs project through said slag layer into the molted metal in the ladle beneath said slag layer, the vacuum degassing unit having means maintaining upward flow of molten metal in the riser leg and sufficient vacuum in the degassing chamber that there is an area of turbulence at the surface of the molten metal in the degassing chamber where the metal from the riser enters said chamber and having a lance in the top thereof and adjustable vertically above said area of turbulence, the steps comprising:

(a) charging a melt of high chromium, high carbon steel with its attendant slag into an open top ladle exposed to the ambient air where the slag forms a protective covering over the molten metal against exposure of the molten metal to the ambient air;

(b) then continuously circulating molten steel substantially free of slag from a level below the slag in the ladle upwardly through the riser leg of the recycle vacuum degassing chamber which is maintained throughout the operation under a partial vacuum and from the degassing chamber returning the molten metal through the down leg of the degassing chamber to the metal in the ladle below the covering slag through a first time period of operation;

(c) in the first time period of such circulation of the metal through the vacuum degassing chamber oxidizing carbon in the molten steel with oxygen gas inherently present and contained in the steel and withdrawing gases generated by such oxidation along with other gases emitted from the steel until degassing of the steel is substantially completed and while elevating the lance above the area of turbulence to a level where it is substantially free of being splashed by the metal;

(d) immediately following the first time period of degassing, continuing the circulation of the molten metal through the degassing chamber, as previously recited, through a second time period while projecting oxygen gas against the turbulent surface of the upflowing molten metal where it enters the degassing chamber through the riser leg and with the lance moved lower to said area of turbulence to thereby then rapidly oxidize the carbon at said surface while oxidation of the chromium in the molten steel is substantially prevented by the rapid displacement of the decarbonized surface metal by reason of the surface turbulence of the incoming metal followed by the quick discharge of the moltem metal after such local exposure to the oxygen back into the ladle, a partial vacuum being maintained in the degassing chamber during this second time period with the withdrawal of reaction and other gases as produced;

(e) immediately following said second time period of oxidation of the metal with oxygen gas and when the carbon content of the metal has been reduced to a predetermined level, continuing the circulation of the molten metal from the ladle through the vacuum degassing chamber for a third time period but with the oxygen gas discharged from the lance now reduced and diluted with an inert gas while maintaining the volume of the mixture of oxygen and inert gas substantially the same as the volume of oxygen alone in said second time period until a final level of minimum carbon content in the molten metal is reached with the lance again raised to a higher level above said area of turbulence to increase its area of contact with the incoming metal, and while continuing to maintain a partial vacuum in the degassing chamber for this third period of time; and (f) thereafter terminating the operation of the degassing unit, deoxidizing the molten metal and effecting the required correction of alloying ingredients made and the molten metal then discharged from the ladle.

2. The method defined in claim 1 wherein the inert gas is mixed with the oxygen in the third time period at the same rate as the volume of the oxygen alone in the second time period, wherein the inert gas is argon, and the mixture comprises 30% argon to 70% oxygen.

3. The method defined in claim 1 wherein inert gas is discharged from the lance during said first period of operation to further protect it from splashing of molten metal.

4. The method defined in claim 1 wherein the oxygen and the mixture of oxygen and inert gas are introduced into the degassing chamber through a nozzle movable toward and away from the turbulent surface area against which the gas is projected and wherein the nozzle is withdrawn from the surface of the molten metal during the first time period a distance sufficiently remote from the molten metal to be out of the reach of splashing turbulent metal and then moved to a distance about one meter removed from the molten metal when oxygen gas only is directed against the metal and then removed to a distance of about two meters from the molten metal during the third time period when the mixture of gases is blown against the molten metal whereby the force of its impingement against the molten metal is reduced.

5. The method defined in claim 1 wherein the melt at the beginning of the process has a chromium content of at least 18% and around 10% of the nickel and carbon of close to 0.19%, reducing the carbon in said three time periods from 0.19% to 0.16% with practically no measurble loss of chromium.

* * * * *